US007355576B2

(12) United States Patent
Song

(10) Patent No.: US 7,355,576 B2
(45) Date of Patent: Apr. 8, 2008

(54) LCD PANEL, LCD INCLUDING SAME, AND DRIVING METHOD THEREOF

(75) Inventor: Jang-Kun Song, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 348 days.

(21) Appl. No.: 09/995,766

(22) Filed: Nov. 29, 2001

(65) Prior Publication Data

US 2002/0097214 A1 Jul. 25, 2002

(30) Foreign Application Priority Data

Dec. 7, 2000 (KR) ..... 2000-74302

(51) Int. Cl.
*G09G 3/36* (2006.01)

(52) U.S. Cl. ..... 345/87; 345/88; 345/92; 345/95; 345/96; 345/98; 345/100

(58) Field of Classification Search ..... 345/87, 345/88, 92, 95–96, 55, 50, 98, 100
See application file for complete search history.

(56) References Cited

U.S. PATENT DOCUMENTS 5,966,191 A * 10/1999 Lee ..... 349/58
6,094,192 A * 7/2000 Kobayashi et al. ..... 345/210
6,310,594 B1 * 10/2001 Libsch et al. ..... 345/90
6,400,424 B1 * 6/2002 Kim et al. ..... 349/38
6,421,039 B1 * 7/2002 Moon et al. ..... 345/100
6,429,842 B1 * 8/2002 Shin et al. ..... 345/92
6,437,775 B1 * 8/2002 Hanari ..... 345/204
6,469,684 B1 * 10/2002 Cole ..... 345/58
6,512,505 B1 * 1/2003 Uchino et al. ..... 345/96
6,573,532 B2 * 6/2003 Park ..... 257/59
6,583,777 B2 * 6/2003 Hebiguchi et al. ..... 345/92
6,677,925 B1 * 1/2004 Kawaguchi et al. ..... 345/98

* cited by examiner

*Primary Examiner*—Richard Hjerpe
*Assistant Examiner*—Leonid Shapiro
(74) *Attorney, Agent, or Firm*—F. Chau and Associates, LLC

(57) ABSTRACT

Disclosed is an LCD panel, an LCD including the LCD panel, and a driving method for high-speed responses. The present invention comprises a plurality of gate lines; a plurality of data lines; a common electrode line formed in the horizontal direction with vertical branches, and formed at a predetermined area between a gate line and its adjacent gate line; a first pixel electrode formed at an odd row of an odd column and even row of an even column among an area formed by a the data line and a gate line; and a second pixel electrode formed at an odd row of an even column and an even row of an odd column of the area, and having a polarity different from the first pixel electrode.

10 Claims, 6 Drawing Sheets

LCD PANEL, LCD INCLUDING SAME, AND DRIVING METHOD THEREOF

BACKGROUND OF THE INVENTION (a) Field of the Invention

The present invention relates to a liquid crystal display (LCD) and a driving method thereof. More specifically, the present invention relates to an LCD panel, an LCD including the same and a method for driving the same to achieve a high-speed response.

(b) Description of the Related Art

As personal computers (PC) and television sets have become lighter in weight and slimmer in thickness, display devices have also been required to become lighter and slimmer, and flat panel displays such as the LCD instead of cathode ray tubes (CRT) have been developed and used in practice to meet such requirements.

In the LCD, an electric field is used to arrange liquid crystal material that has anisotropic permittivity and is provided between two substrates. By adjusting the strength of the electric field, lights that transmits the substrates are adjusted. Accordingly, desired image signals are obtained. The LCD is one of the most used portable flat panel displays. Particularly, thin film transistor (TFT) LCDs using TFTs as switching elements are widely used.

FIG. 1 shows a pixel equivalent circuit of a general TFT-LCD.

As shown, the pixel of the general TFT-LCD comprises a TFT switching element that has a source electrode coupled to a data line and a gate electrode to a gate line; a liquid crystal capacitor $C_{lc}$ coupled to the drain electrode of the TFT switching element; a storage capacitor $C_{st}$ coupled to the drain electrode of the TFT switching element; a parasitic capacitor $C_{gd}$ provided between the gate and drain electrodes of the TFT switching element; a parasitic capacitor $C_{ds}$ provided between the drain and source electrodes of the TFT switching element; and an overlap capacitor $C_{over}$ provided between the data line and a pixel electrode.

An operation of the liquid crystal provided between the pixel electrode on a TFT substrate and a common electrode on a color filter substrate will now be described.

First, when a bipolar pulse is supplied via the gate line, the TFT switching element is turned on. At this time, a signal voltage supplied to the source electrode of the TFT switching element via a signal line is supplied to a liquid crystal capacitor and a storage capacitor via the drain electrode. The signal voltage supplied together with the gate pulse is maintained by the storage capacitor and supplied to the liquid crystal capacitor after the gate voltage is turned off.

According to the above-described method for manufacturing the storage capacitor, the TFT-LCD is categorized as a previous gate method (or an additional capacitance method) as shown in FIG. 2*a*, and a common method (or an individual wiring method) as shown in FIG. 2*b*.

As shown, the previous gate method uses a capacitor provided between a pixel electrode and a previous gate as a storage capacitor, and the common method generates a storage electrode in the pixel electrode and uses a capacitor between the storage electrode and the pixel electrode as the storage capacitor. The storage electrode of the common method is connected to a transparent common electrode line of the color filter substrate and is then driven.

When using an LCD to big screen applications, the biggest restriction is the response time. For a big size LCD, this invention is directed to a method for improving the response speed of the LCD using the previous gate method.

FIG. 3 shows a pixel equivalent circuit of the TFT-LCD using the previous gate, and FIG. 4 shows waveforms for describing the improvement of the response speed using the previous gate of FIG. 3.

As shown in FIG. 3, in the pixel equivalent circuit of the TFT-LCD, one terminal of the storage capacitor Cst is connected to the drain electrode and another terminal to the previous gate.

In operation, a predetermined switching pulse signal is supplied to the gate line, and the voltage finally supplied to the pixel by the common electrode voltage is as follows:

$$V_p = \pm V_s + \frac{C_{st}}{C_{st} + C_{gd} C_{lc}} \cdot \Delta V_g \qquad \text{Equation 1}$$

where Vs represents the voltage supplied to the source electrode, $C_{st}$ represents the capacitance of the storage capacitor, $C_{gd}$ represents the parasitic capacitance between the gate and drain electrodes, $C_{lc}$ represents the capacitance of the liquid crystal capacitor, and $\Delta V_g$ represents the difference voltage between the previous gate voltage and the present gate voltage.

However, since the above-noted method uses the previous gate structure, a heavy gate load is generated. Also, since the method can only be applied to line inversion driving, cross-talk and flickers are generated and it is difficult to achieve a high degree of precision.

Also, conventional gate TAP-ICs (Tape Aided Bonding-Integrated Circuits) cannot be used, and if the gate voltage at an off state is heavily increased, the off state current $I_{off}$ becomes great. And accordingly, gate value modification is limited.

SUMMARY OF THE INVENTION

It is an object of the present invention to provide an LCD panel of an LCD by swinging the common electrode voltage supplied to a storage common electrode line to obtain a high response speed in an independent wiring structure of an LCD that can do dot inversion driving.

In one aspect of the present invention, an LCD panel comprises a plurality of gate lines formed in the horizontal direction with vertical branches, a plurality of data lines formed in the vertical direction with horizontal branches, a common electrode line formed in the horizontal direction with vertical branches, and formed at a predetermined area between a gate line and its adjacent gate line, a first pixel electrode formed on an odd row of an odd column and an even row of an even column among areas formed by the data lines and gate lines crossing the data lines; and a second pixel electrode formed on an odd row of an even column and an even row of an odd column of the areas, and having a polarity different from the first pixel electrode.

The first pixel electrode is formed at an area respectively divided by an odd data line and its subsequent adjacent even data line and by connecting an odd gate line and its subsequent adjacent common electrode line, and formed at an area respectively divided by an even data line and its subsequent adjacent odd data line and by connecting an even common electrode line and its subsequent adjacent gate line. The second pixel electrode is formed at an area respectively divided by an even data line and its subsequent adjacent odd data line and by connecting an odd common electrode line and its subsequent adjacent gate line, formed at an area respectively divided by an odd data line and its subsequent adjacent even data line and by connecting an even gate line and its subsequent adjacent common electrode line.

In another aspect of the present invention, an LCD for a high-speed response comprises a timing controller for outputting first driving signal and second driving signal, and outputting a third driving signal that defines periods and amplitudes according to vertical and horizontal synchronization signals and a main clock signal; a data driver for outputting an image signal that drives a polarity of a liquid crystal capacitor based on the first driving signal, a gate driver for outputting a scanning signal based on the second driving signal, a driving voltage generator for receiving the third driving signal, raising or lowering levels of the third driving signal, and outputting a common electrode voltage that is synchronized with the image signal in a predetermined period and swung, and an LCD panel for displaying the image signal in cooperation with the common electrode voltage and the scanning signal in an independent wiring structure that forms gate lines in the horizontal direction and common electrode lines between the gate lines.

Also disclosed is a method for driving an LCD with above-described structure. The method comprises the steps of receiving an image signal from an external image signal source and providing the image signal to a data line, generating a first scanning signal so as to provide the same to an odd pixel of an odd gate line and an even pixel of an even gate line, generating a second scanning signal so as to provide the same to an odd pixel of an even gate line and an even pixel of an odd gate line, sequentially providing the first and second scanning signals to the gate line, and supplying a common electrode voltage to a common electrode line so as to superimpose voltage to transmission (VT) curves of positive and negative polarity driving together with the sequential providing of the first scanning signal and the second scanning signal.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, only the preferred embodiment of the invention has been shown and described, simply by illustrating the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 1:
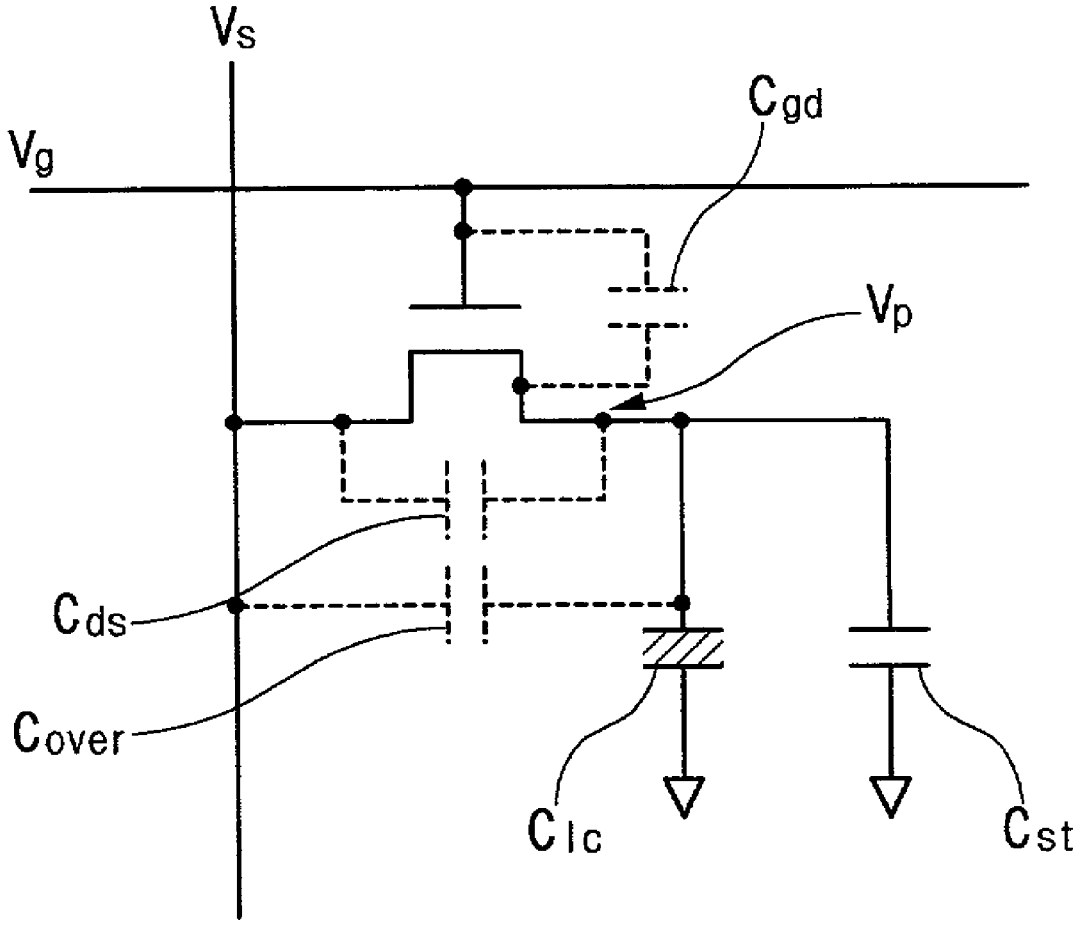
FIG. 1 shows a pixel equivalent circuit of a general TFT-LCD.
Figure 2A:
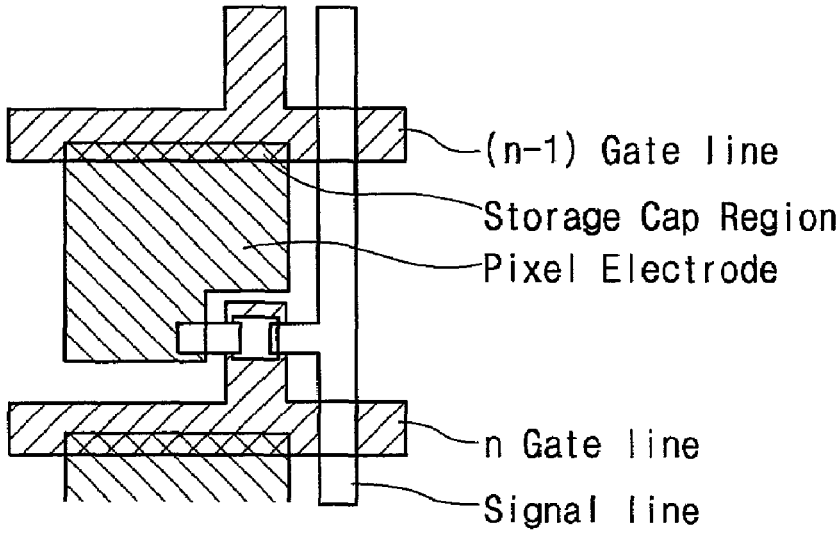
FIGS. 2*a* and 2*b* respectively show schematic diagrams for the previous gate method and independent wiring method.
Figure 2B:
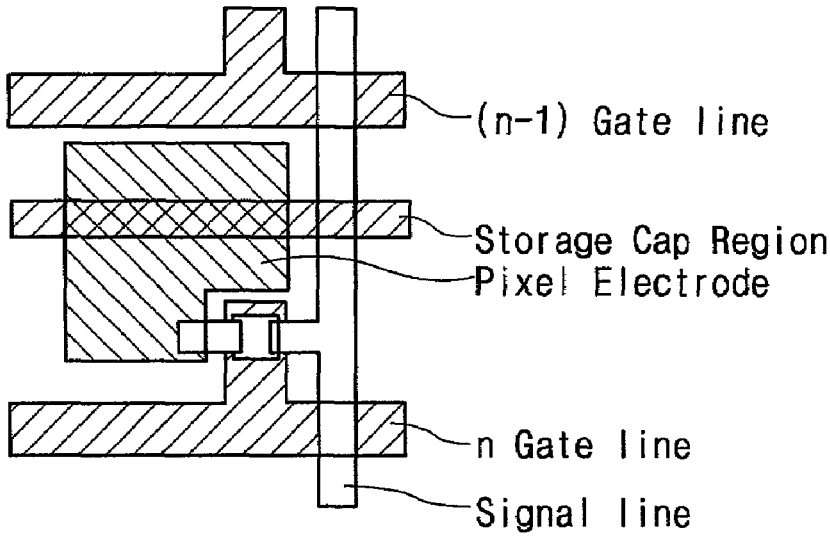
Figure 3:
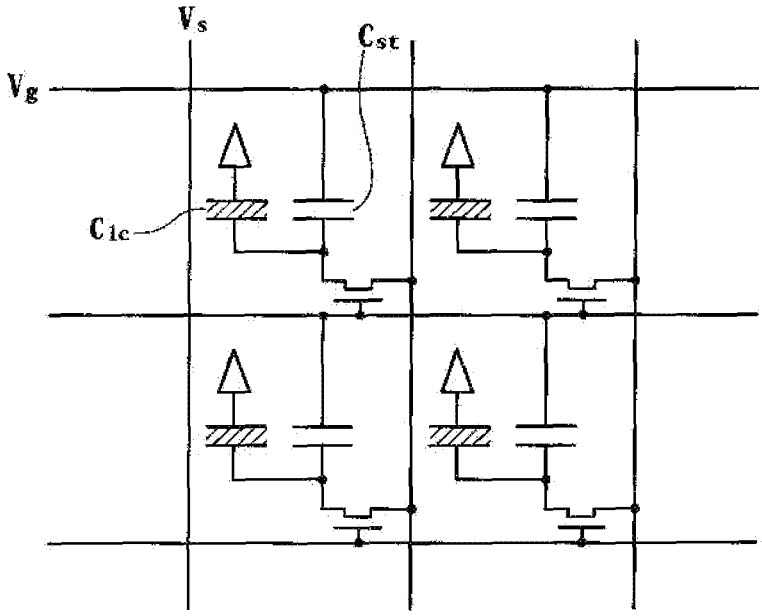
FIG. 3 shows a schematic diagram for the pixel equivalent circuit of the TFT-LCD using the previous gate.
Figure 4:
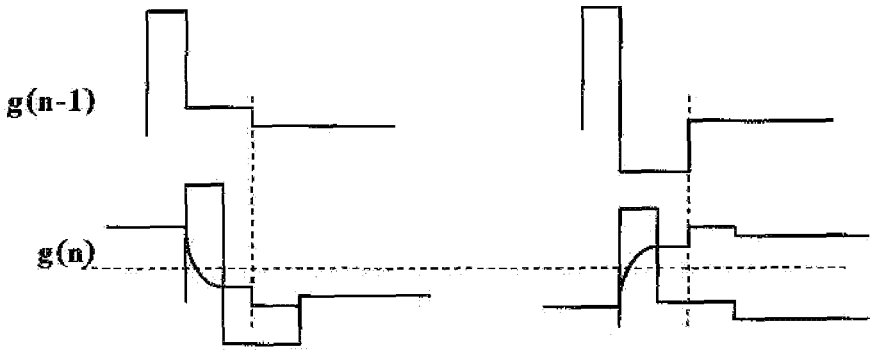
FIG. 4 shows waveforms for describing an improvement of a response speed using a previous gate signal of FIG. 3.
Figure 5:
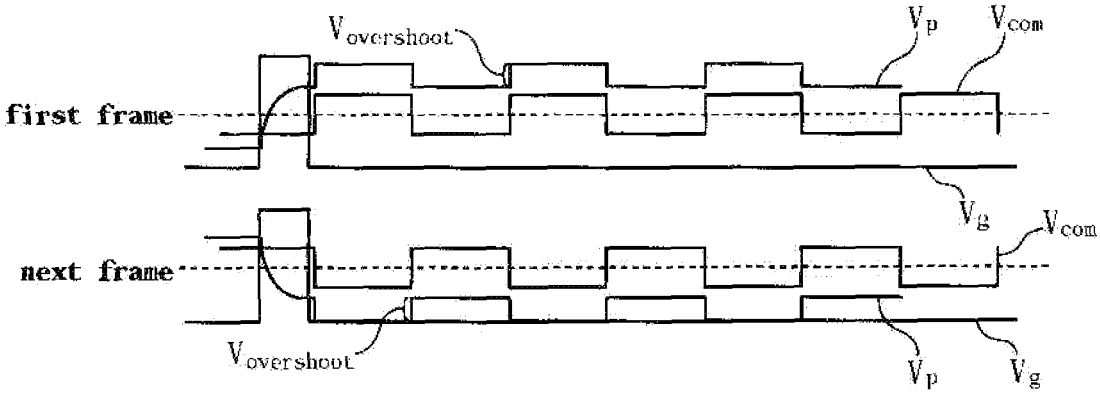
FIG. 5 shows waveforms for describing changes of a pixel voltage according to periodic swing common voltage.

FIG. 5 shows waveforms for describing changes of a pixel voltage according to periodic common voltage swings.

As shown in FIG. 5, for illustrating the voltages supplied to a single pixel, the voltage supplied to the pixel is swung by swinging the common electrode voltage supplied to the common electrode line. At this time, the average voltage Vp supplied to the pixel is as follows:

$$V_p = \pm V_s + \frac{C_{st}}{2\cdot(C_{st}+C_{gd}+C_{lc})}\cdot\Delta V_{com} \qquad \text{Equation 2}$$

where $V_s$ represents the voltage supplied to the source electrode, $C_{st}$ represents the capacitance of the storage capacitor, $C_{gd}$ represents the parasitic capacitance between the gate and drain electrodes, $C_{lc}$ represents the capacitance of the liquid crystal capacitor, and $\Delta V_{com}$ represents the swing width of the voltage supplied to the common electrode line.

As expressed in Equation 2, since the voltage additionally supplied to the common electrode is proportional to a value of $C_{st}/(C_{st}+C_{lc})$, when the gray is modified according to a memory effect by the liquid crystal capacitor Clc, an overshoot effect is generated, and hence the response speed of the liquid crystal can be improved.

When the overshoot is generated to improve the response speed of the liquid crystal and the three subsequent conditions are satisfied, the response speed of the LCD can be improved.

(1) Condition 1.

In the case the pixel voltage is switched from negative polarity to positive polarity, the common electrode voltage is terminated by the negative polarity at the gate-on time.

(2) Condition 2.

In the case the pixel voltage is switched from positive polarity to negative polarity, the common electrode voltage is terminated by the positive polarity at the gate-on time.

(3) Condition 3.

After the gate is closed, the common electrode voltage repeatedly swings between the negative and positive polarities.

On the other hand, the overshoot caused by the liquid crystal capacitor $C_{lc}$ is given as follows.

First, if the capacitances of the respective liquid crystal capacitors $C_{lc}$ are set as $C_{lc1}$ and $C_{lc2}$ when the first gray state is switched to the second gray state, a difference between the second terms of equation 2 of the respective states becomes an overshoot value, as follows:

$$V_{overshot} = \left[\frac{C_{st}}{2(C_{st}+C_{lct})} - \frac{C_{st}}{2(C_{st}+C_{lc2})}\right]\cdot\Delta V_{com} = \qquad \text{Equation 3}$$

-continued $$\frac{\Delta V_{com} \cdot C_{st}(C_{lc2} - C_{lc1})}{2(C_{st} + C_{lc1}) \cdot (C_{st} + C_{lc2})}$$

Figure 6:
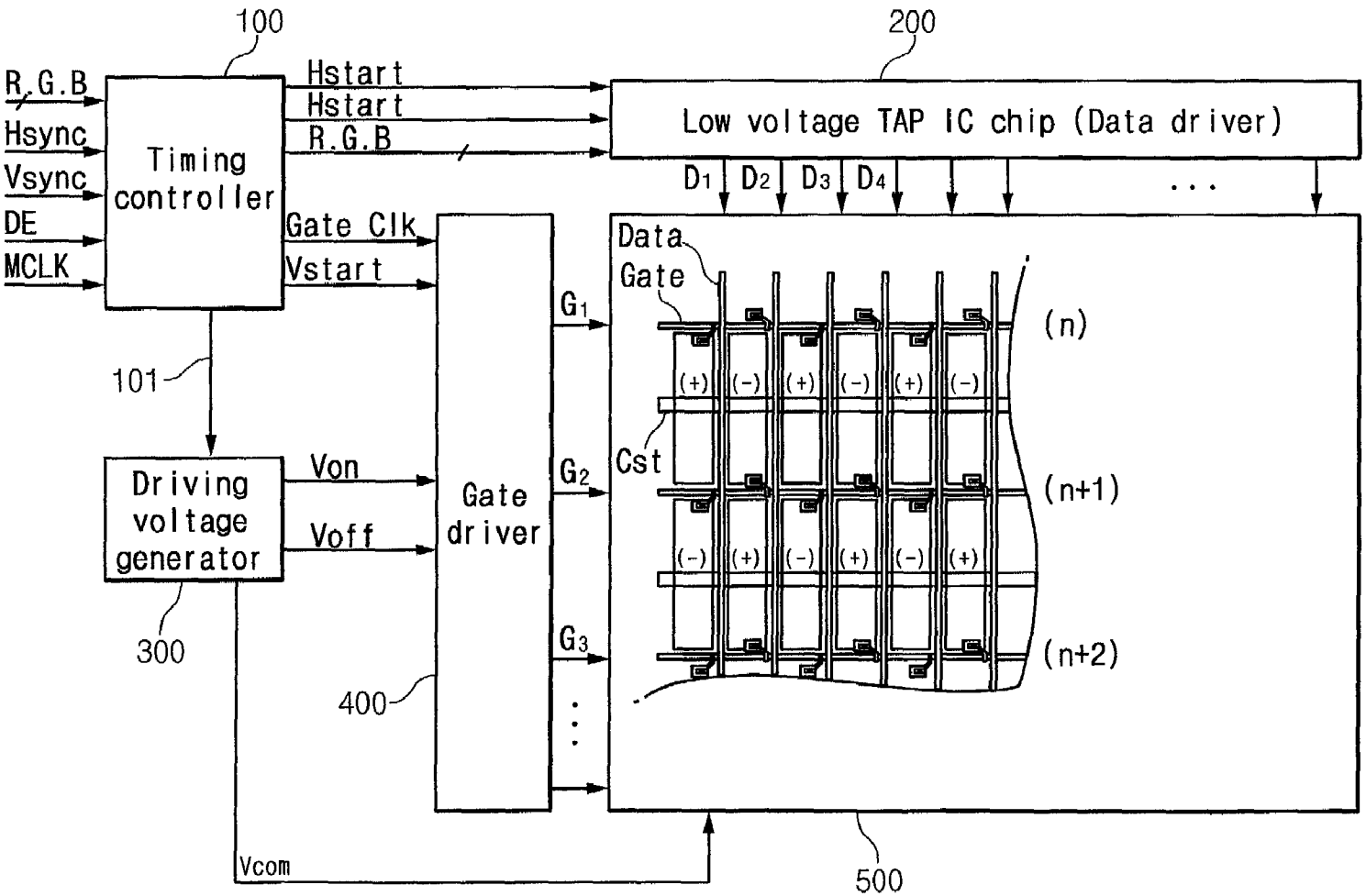
FIG. 6 shows a schematic diagram for describing an LCD for a high-speed response according to a preferred embodiment of the present invention.

FIG. 6 shows a schematic diagram for describing an LCD for a high-speed response according to a preferred embodiment of the present invention.

Referring to FIG. 6, the LCD for a high-speed response comprises a timing controller 100, a data driver 200, a gate driver 400, a driving voltage generator 300 and an LCD panel 500.

The timing controller 100 outputs a first signal 101 that defines the periods and amplitudes of the common electrode voltage Vcom to the driving voltage generator 300 according to the vertical synchronization signal Vsync, horizontal synchronization signal Hsync and main clock signal MCLK; outputs data driver driving signals LOAD, Hstart, R, G and B to the data driver 200; and outputs gate driver driving signals Gate Clk and Vstart to the gate driver 400.

The data driver 200 outputs data driving voltages $D_1$ through $D_m$ that drive the polarity of the liquid crystal capacitor $C_{lc}$ using the data driver driving signals, to data lines of the LCD panel 500. Here, the data driver 200 uses a line inversion low voltage driving TAP IC, and the low voltage ranges from 0 to 5 volts.

The driving voltage generator 300 receives the first signals 101 from the timing controller 100 and raises or lowers the voltage levels of the first signal 101, outputs gate driving voltages Von and Voff for driving the gate driver to the gate driver 400, and outputs the common electrode voltage Vcom that swings and synchronizes with the gate driving voltage by a predetermined period, to the LCD panel 500. At this time, the common electrode voltage can be a square wave having a period identical to or three times that of the gate driving voltage.

The gate driver 400 outputs gate driving voltages $G_1$ through $G_n$ to the LCD panel 500 using the gate driver driving signals Gate Clk and Vstart provided by the timing controller 100, and the gate driving voltages Von and Voff provided by the driving voltage generator 300.

The LCD panel 500 uses an independent wiring structure that includes a plurality of gate lines, data lines, common electrode lines, switching elements (TFTs) connected to the respective gate lines and data lines, liquid crystal capacitor $C_{lc}$ and storage capacitor $C_{st}$, and displays the data voltages (or image signals) provided by the data driver 200 in response to the gate voltage (or a scanning signal) provided by the gate driver 400 and the common electrode voltage Vcom provided by the driving voltage generator 300.

In detail, the gate lines formed in the horizontal direction transmit the scanning signals $G_1$, $G_2$, . . . provided by the gate driver 400, and the data lines formed crossing the gate lines are formed in the vertical direction and transmit image signals $D_1$, $D_2$, $D_3$, provided by the data driver 200, and the common electrode line that transmits the common electrode voltage Vcom provided by the driving voltage generator 300 is formed between a gate line and its adjacent gate line.

A first end of the switching element (TFT) formed by an area surrounded by the gate lines and data lines is connected to the gate line, a second end to the data line, and a third end to the common electrode line so as to perform On and Off operations.

The liquid crystal capacitor $C_{lc}$ transmits the light from a backlight (not illustrated) in proportion to the image signals provided by the data driver 200 according to turn-on operation of the switching element, and the storage capacitor $C_{st}$ stores the image signals provided by the data driver 200 when the switching element is turned on, and supplies the stored image signals to the liquid crystal capacitor $C_{lc}$ when the switching element is turned off.

Figure 7:
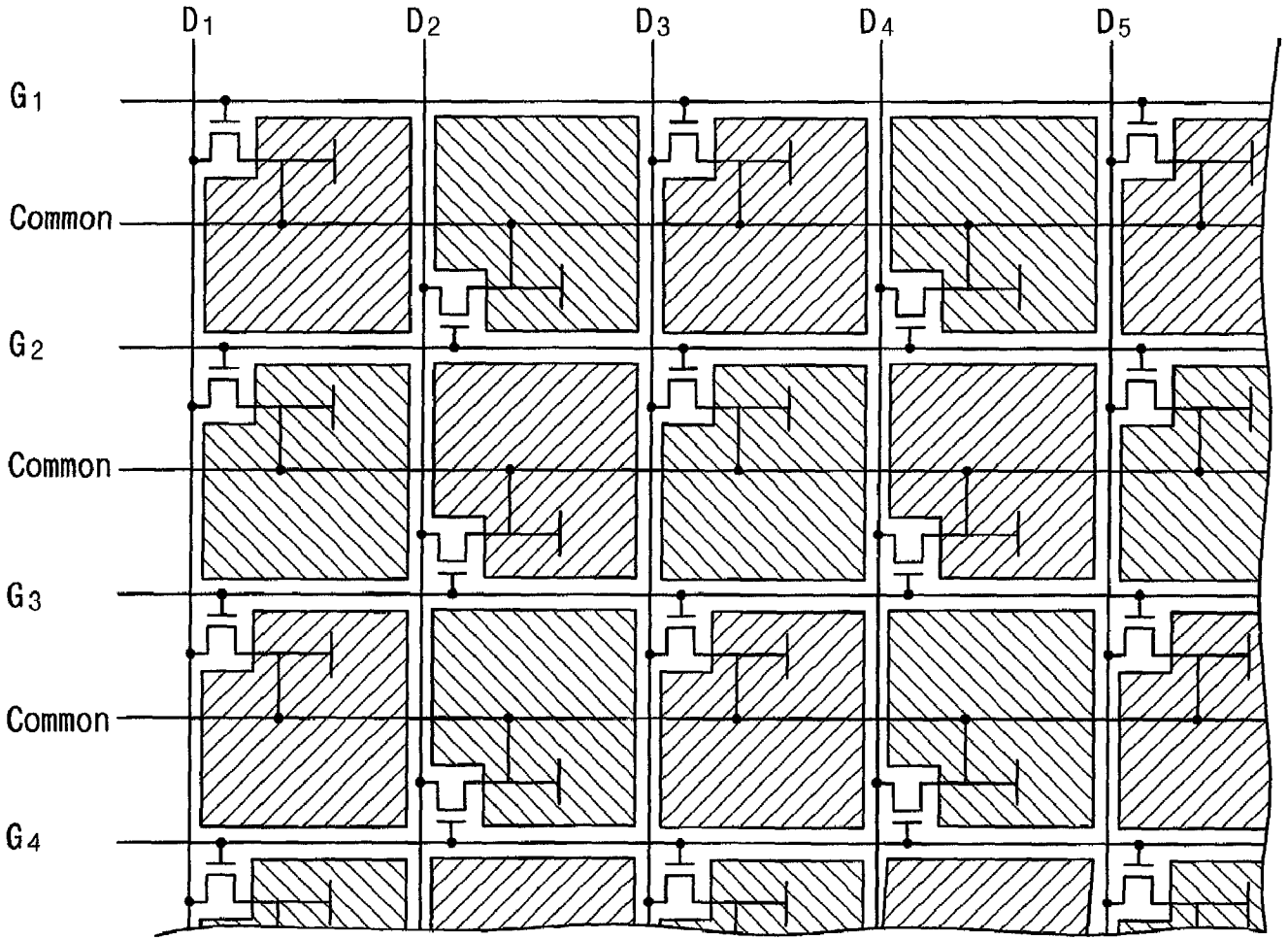
FIG. 7 shows a schematic diagram for describing the pixel equivalent circuit of the LCD panel of FIG. 6.

FIG. 7 shows a schematic diagram for describing the pixel equivalent circuit of the LCD panel of FIG. 6.

As shown, the LCD panel uses an independent wiring structure, and at this time, the gate lines are formed in the horizontal direction with vertical branches, the data lines are formed in the vertical direction with horizontal branches, and the common electrode lines each formed in a predetermined area made between a gate line and a subsequent adjacent gate line are formed in the horizontal direction with vertical branches.

First pixel electrodes are formed at areas respectively surrounded by an odd data line and its subsequent adjacent even data line and are connected to an odd gate line and its subsequent adjacent common electrode line.

Also, the first pixel electrodes are formed at the areas respectively surrounded by an even data line and its subsequent adjacent odd data line and are connected to an even common electrode line and its subsequent adjacent gate line.

Second pixel electrodes are formed at areas respectively surrounded by an even data line and its subsequent adjacent odd data line and are connected to an odd common electrode line and its subsequent adjacent gate line.

Also, the second pixel electrodes are formed at the areas respectively surrounded by an odd data line and its subsequent adjacent even data line and are connected to an even gate line and its subsequent adjacent common electrode line.

Here, the first pixel electrode has a polarity different from that of the second pixel electrode.

The LCD panel and the LCD including the same according to the preferred embodiment of the present invention use independent wiring structures. Swinging the common electrode voltage supplied to the common electrode line for storage enables the LCD to achieve the high speed response of the liquid crystal. Further, the merits of dot inversion driving can be obtained by positioning the gates differently.

That is, as shown in FIGS. 6 and 7, since the LCD panel comprises the gate lines provided in the horizontal direction and the common electrode lines between the gate lines and has the independent wiring method, high-speed response of the LCD can be performed not by using a data driver for dot inversion driving (or a dot inversion TAP IC) but by using a cheaper data driver for line inversion driving (or a line inversion driving TAP IC).

Also, even when the line inversion TAP IC is used as the data driver instead of the dot inversion TAP IC, the LCD panel can perform the dot inversion operation.

An LCD panel for high-speed responses, and an LCD including the LCD panel and its driving method according to the present invention will now be described in detail.

Figure 8:
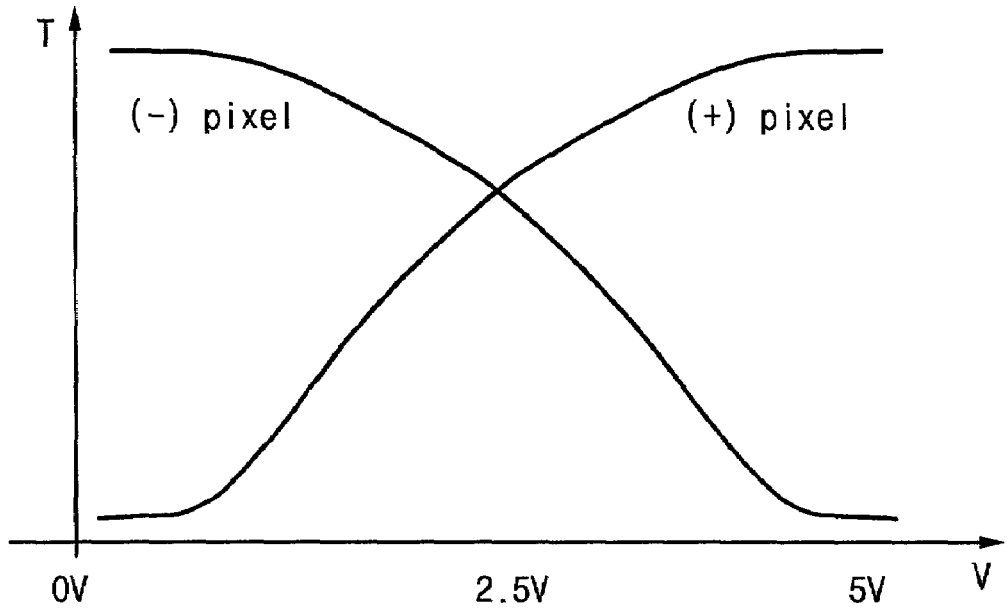
FIG. 8 shows a VT (voltage to transmission) curve according to the preferred embodiment of the present invention.

The size of the voltage supplied to the pixel by the common electrode voltage that is swung when the voltage is supplied to the data line is expressed in equation 2, and the voltage Vp' supplied to the pixel with respect to the top substrate common electrode voltage $V_{CF\text{-}com}$ is expressed in equation 4, and the VT curve is shown in FIG. 8.

$$V_p' = \left[V_s + \frac{C_{st}}{2 \cdot (C_{st} + C_{gd} + C_{lc})} \cdot \Delta V_{com}\right] - V_{CF-com} \qquad \text{Equation 4}$$

If the common electrode voltage for storage is not swung, the VT curves are formed on both parts with respect to the common electrode voltage, but if the common electrode voltage is swung, as shown in FIG. 8, both VT curves move to the central part, and the white mode that is the positive (+) portion and the black mode that is the negative (−) portion are superimposed. At this time, the shifted voltage Vshift is expressed by the second term on the right of equation 2. That is:

$$V_{shift} = \frac{C_{st}}{2\cdot(C_{st}+C_{gd}+C_{lc})}\cdot\Delta V_{com}.$$

Therefore, as shown in FIG. 8, when the VT shift degree is set about 5V, the two VT curves are completely superimposed, and the LCD panel can be driven even when the low voltage TAP IC is used as the data driver.

The amplitude of the common electrode voltage to be swung for completely superimposing the VT curves of the LCD that uses the independent wiring method will now be described.

Figure 9:
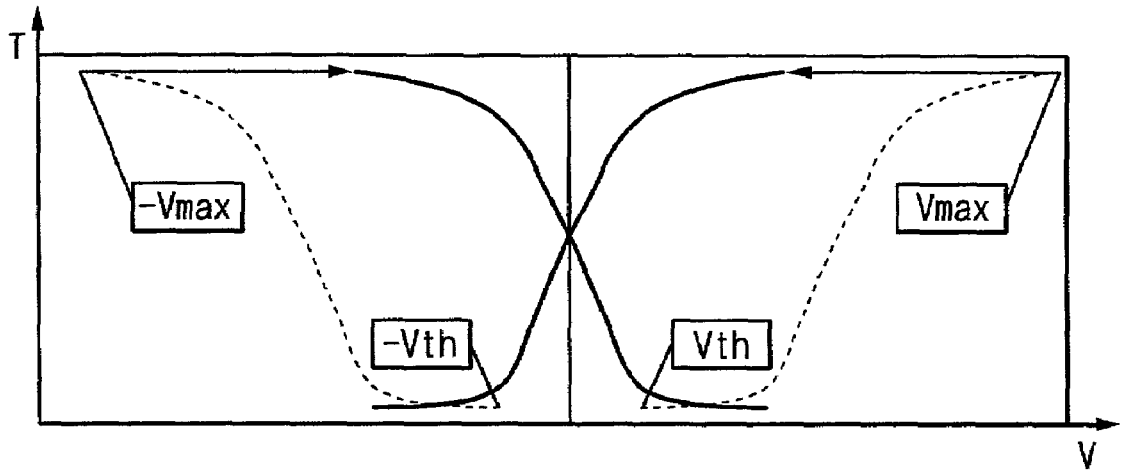
FIG. 9 shows a graph for describing a minimum value (Vth) of an actual voltage sensed by the liquid crystal and a maximum value (Vmax) of the actual voltage sensed by the liquid crystal, the liquid crystal being positioned on the VT curve in a normal case.

FIG. 9 shows a graph for describing a minimum value (Vth) of an actual voltage sensed by the liquid crystal and a maximum value (Vmax) of the actual voltage sensed by the liquid crystal, the liquid crystal being positioned on the VT curve in a normal case.

As shown, the dotted lines respectively represent the normally black mode and normally white mode on the (+) and (−) portions when the common electrode voltage Vcom is not swung, and the VT curves move to the central part when the common electrode voltage is swung. At this time, when an appropriate common electrode voltage is swung, the two VT curves are superimposed as shown in FIG. 8. Here, the positive and negative polarity voltage will be 5V when a 10V TAP IC of the data driver is used, and it will be 2.5V when a 5V TAP IC is used.

A method for swinging the common electrode voltage supplied to the common electrode line so as to completely superimpose the VT curves of the LCD panel will now be described.

Referring to FIG. 9, it can be found that Vmax−Vshift (white)=−Vth+Vshift(black). At this time, since the shift voltage Vshift is the second term on the right portion of equation 2, it follows that:

$$V_{\max} - \frac{C_{st}}{2\cdot(C_{st}+C_{gd}+C_{lc-white})}\cdot\Delta V_{com} = -V_{th} + \frac{C_{st}}{2\cdot(C_{st}+C_{gs}+C_{lc-black})}\cdot\Delta V_{com}.$$

Since $C_{gd}$ can be neglected, the amplitude of the voltage supplied to the common electrode line to be swung using a low voltage driving TAP IC is as follows:

$$\Delta V_{com} = \frac{2\cdot(V_{\max}+V_{th})\cdot(C_{st}+C_{lc-black})\cdot(C_{st}+C_{lc-white})}{C_{st}\cdot(2C_{st}+C_{lc-white}+C_{lc-black})} \quad \text{Equation 5}$$

where $V_{max}$ represents the maximum value of the actual voltage sensed by the liquid crystal, $V_{th}$ represents the minimum value of the actual voltage sensed by the liquid crystal, $C_{lc}$ represents the liquid crystal capacitance, $C_{st}$ represents the storage capacitance, $C_{lc\text{-}black}$ represents the liquid crystal capacitance of the black mode, and $C_{lc\text{-}white}$ represents the liquid crystal capacitance of the white mode.

A swing amplitude of the voltage supplied to the common electrode line according to sizes of the liquid crystal capacitance $C_{lc}$ and the storage capacitance $C_{st}$, voltage at the liquid crystal, and the size of the overshoot will now be described in detail.

(i) in the case $C_{lc}=C_{st}$($C_{st}=2\times C_{lc\text{-}black}$ in the black state), When the amplitude of the voltage supplied to the common electrode line is ΔV>0 and zero Volts are supplied to a data line in the black state, the voltage supplied to the pixel is as follows, based on equations 4 and 5:

$$V'_{p(black)} = \left[\frac{C_{st}}{2\cdot(C_{st}+C_{gd}+C_{ic-black})}\cdot\Delta V_{com}\right] - V_{CF-com} = \frac{\Delta V_{com}}{3} - 2.5 \quad \text{Equation 6}$$

where it is assumed that $C_{gd}=0$ and $V_{CF\text{-}com}=2.5$.

Also, when the amplitude of the voltage supplied to the common electrode line is ΔV>0 and 5 Volts are supplied to a data line in the white state, the voltage supplied to the pixel is as follows, based on equations 4 and 5:

$$V'_{p(white)} = \left[5 - \frac{C_{st}}{2\cdot(C_{st}+C_{gd}+C_{ic-black})}\cdot\Delta V_{com}\right] - V_{CF-com} = \frac{\Delta V_{com}}{4} + 2.5 \quad \text{Equation 7}$$

where it is assumed that $C_{gd}=0$ and $V_{CF\text{-}com}=2.5$.

Since the black mode voltage must not be greater than 1.7V, and hence it is found from equation 7 that $$\frac{\Delta V_{com}}{3} - 2.5 < 1.7,$$

it follows that $\Delta V_{com}<12.6$. Based on this, equation 8 becomes such that V'p(white)<12.6/4+2.5=5.65.

Therefore, if the common electrode voltage is swung in 12V, the actual voltage V'p(black)=1.5V and V'p(white) =5.5V, and the size of the overshoot is 1.0V.

(ii) in the case $C_{lc}=2\times C_{st}$($C_{st}=C_{lc\text{-}black}$ in the black state), When the amplitude of the voltage supplied to the common electrode line is ΔV>0 and zero Volts are supplied to a data line in the black state, the voltage supplied to the pixel is as follows, based on equations 4 and 5:

$$V'_{p(black)} = \left[\frac{C_{st}}{2\cdot(C_{st}+C_{gd}+C_{lc-black})}\cdot\Delta V_{com}\right] - V_{CF-com} = \frac{\Delta V_{com}}{4} - 2.5 \quad \text{Equation 8}$$

where it is assumed that $C_{gd}=0$ and $V_{CF\text{-}com}=2.5$.

Also, when the amplitude of the voltage supplied to the common electrode line is ΔV>0 and 5 Volts are supplied to a data line in the white state, the voltage supplied to the pixel is as follows, based on equations 4 and 5:

$$V'_{p(white)} = \left[5 - \frac{C_{st}}{2\cdot(C_{st}+C_{gd}+C_{lc-black})}\cdot\Delta V_{com}\right] - V_{CF-com} = \frac{\Delta V_{com}}{6} + 2.5 \quad \text{Equation 9}$$

where it is assumed that $C_{gd}=0$ and $V_{CF\text{-}com}=2.5$.

Since the black mode voltage must not be greater than 1.7V, and since it is found from equation 9 that $$\frac{\Delta V_{com}}{4} - 2.5 < 1.7V,$$

the swing amplitude ($\Delta V_{com}$) of the common electrode line must be less than 16.8V.

Based on this, the actual voltages supplied to the liquid crystal are as follows, according to equations 8 and 9: V'p(black)<1.7V, V'p(white)<16.8/6+2.5=5.3V, and the voltage of the overshoot is 1.4V.

According to the present invention, the conventional 13V high voltage dot inversion TAP IC can be used, and when this is substituted by the 5V low voltage line inversion TAP IC, the driving voltage of the LCD can be reduced since the maximum value of the actual voltage sensed by the liquid crystal is 5.5V.

Also, since the overshoot ranges from 1.0 to 1.4V, the response speed by the overshoot can be improved.

Further, when the gray is switched from a higher degree to a first degree, a voltage lower than the first gray voltage is supplied and a turn-off time of the liquid crystal is shortened. When the gray is switched from the first one to another, the liquid crystal is more quickly turned on since another voltage is supplied from the first gray voltage.

Also, acuteness of the VT curves is lowered.

While this invention has been described in connection with what is presently considered to be the most practical and preferred embodiment, it is to be understood that the invention is not limited to the disclosed embodiments, but on the contrary, is intended to cover various modifications and equivalent arrangements included within the spirit and scope of the appended claims.

What is claimed is:

1. A method for driving a liquid crystal display including a top substrate common electrode a plurality of gate lines, a plurality of data lines, a plurality of common electrode lines arranged alternately between the plurality of gate lines, a plurality of pixels connected to the plurality of gate lines and the plurality of data lines and arranged in a matrix, said method comprising:

applying a first data voltage of a first polarity to the plurality of data lines;

providing a first scanning signal for odd pixels in an odd row and even pixels in an even row;

applying a second data voltage of a second polarity opposite to the first polarity to the plurality of data lines;

providing a second scanning signal for odd pixels in an even row and even pixels in an odd row;

supplying the common electrode lines with a swinging common electrode voltage; and supplying an overshoot voltage to a voltage applied to each pixel in response to the first data voltage and the second data voltage upon a variation of a level of the swinging common electrode voltage, wherein a level of the voltage applied to each pixel is varied in response to the overshoot voltage.

2. The method for driving the liquid crystal display of claim 1, wherein the swinging common electrode voltage has a square waveform having a same period as the first scanning signal and the second scanning signal.

3. The method for driving the liquid crystal display of claim 1, wherein the swinging common electrode voltage has a square waveform having a three times longer period than the first scanning signal and the second scanning signal.

4. The method for driving the liquid crystal display of claim 1, wherein the overshoot voltage is determined as:

$$V_{overshot} = \frac{\Delta V_{com}\cdot C_{st}(C_{lc2}-C_{lc1})}{2(C_{st}+C_{lc1})\cdot(C_{st}+C_{lc2})}$$

where $V_{com}$ represents the swinging common electrode voltage, $C_{lc1}$ and $C_{lc2}$ capacitances of a liquid crystal capacitor at the first grey state and the second grey state, respectively, $C_{st}$ represents a storage capacitance.

5. A method for driving a liquid crystal display including a plurality of gate lines, a plurality of data lines, a plurality of common electrode lines arranged alternately between the plurality of gate lines, a plurality of pixels connected to the plurality of gate lines and the plurality of data lines and arranged in a matrix, said method comprising:

applying a first data voltage of a first polarity to the plurality of data lines;

providing a first scanning signal for odd pixels in an odd row and even pixels in an even row;

applying a second data voltage of a second polarity opposite to the first polarity to the plurality of data lines;

providing a second scanning signal for odd pixels in an even row and even pixels in an odd row; and supplying the common electrode lines with a swinging common electrode voltage;

wherein a swing amplitude of the swinging common electrode voltage is established as:

$$\Delta V_{com} = \frac{2(V_{\max}+V_{th})(C_{st}+C_{lc-black})(C_{st}+C_{lc-white})}{C_{st}(2C_{st}+C_{lc-white}+C_{lc-black})}$$

where $V_{max}$ represents the maximum value of the actual voltage sensed by a liquid crystal, $V_{th}$ represents the minimum value of the actual voltage sensed by the liquid crystal, $C_{lc}$ represents a liquid crystal capacitance. $C_{st}$, represents a storage capacitance, $C_{lc\text{-}white}$ represents the liquid crystal capacitance in a black mode, and $C_{lc\text{-}white}$ represents the liquid crystal capacitance in a white mode.

6. A method for driving a liquid crystal display including a top substrate common electrode, a plurality of gate lines, a plurality of data lines, a plurality of common electrode lines arranged alternately between the plurality of gate lines, a plurality of first pixels and a plurality of second pixels connected to the plurality of gate lines and the plurality of data lines and arranged alternately in rows and columns, said method comprising:

applying a first data voltage of a first polarity to the plurality of data lines;

providing a first scanning signal for odd pixels in an odd row and even pixels in an even row;

applying a second data voltage of a second polarity opposite to the first polarity to the plurality of data lines;

providing a second scanning signal for odd pixels in an even row and even pixels in an odd row;

supplying the common electrode lines with a swinging common electrode voltage; and supplying an overshoot voltage to a voltage applied to each pixel in response to the first data voltage and the second data voltage upon a variation of a level of the swinging common electrode voltage, wherein a level of the voltage applied to each pixel is varied in response to the overshoot voltage.

7. The method of claim 6, wherein the swinging common electrode voltage has a square waveform having a same period as the first scanning signal and the second scanning signal.

8. The method of claim 6, wherein the swinging common electrode voltage has a square waveform having a period three times longer than the first scanning signal and the second scanning signal.

9. The method for driving the liquid crystal display of claim 6, wherein the overshoot voltage is determined as:

$$V_{overshot} = \frac{\Delta V_{com} \cdot C_{st}(C_{lc2} - C_{lc1})}{2(C_{st} + C_{lc1}) \cdot (C_{st} + C_{lc2})}$$

where $V_{com}$ represents the swinging common electrode voltage, $C_{lc1}$ and $C_{lc2}$ capacitances of a liquid crystal capacitor at the first grey state and the second grey state, respectively, $C_{st}$ represents a storage capacitance.

10. A method for driving a liquid crystal display including a plurality of gate lines, a plurality of data lines, a plurality of common electrode lines arranged alternately between the plurality of gate lines, a plurality of first pixels and a plurality of second pixels connected to the plurality of gate lines and the plurality of data lines and arranged alternately in rows and columns, said method comprising:

applying a first data voltage of a first polarity to the plurality of data lines;

providing a first scanning signal to the plurality of first pixels in pairs of neighboring rows;

applying a second data voltage of a second polarity opposite to the first polarity to the plurality of data lines;

providing a second scanning signal to the plurality of second pixels in pairs of neighboring rows; and supplying the common electrode lines with a swinging common electrode voltage;

a swing amplitude of the swinging common electrode voltage is established as:

$$\Delta V_{com} = \frac{2(V_{\max} + V_{th})(C_{st} + C_{lc-black})(C_{st} + C_{lc-white})}{C_{st}(2C_{st} + C_{lc-white} + C_{lc-black})}$$

where $V_{max}$ represents the maximum value of the actual voltage sensed by a liquid crystal, $V_{th}$ represents the minimum value of the actual voltage sensed by the liquid crystal, $C_{lc}$ represents a liquid crystal capacitance, $C_{st}$ represents a storage capacitance, $C_{lc\text{-}block}$ represents the liquid crystal capacitance in a black mode, and $C_{lc\text{-}block}$ represents the liquid crystal capacitance in a white mode.

* * * * *